US011638108B2

(12) United States Patent
Wang et al.

(10) Patent No.: US 11,638,108 B2
(45) Date of Patent: Apr. 25, 2023

(54) CANAL HEARING DEVICES WITH SOUND PORT CONTAMINANT GUARDS

(71) Applicant: Sonova AG, Stäfa (CH)

(72) Inventors: Frank Wang, San Bruno, CA (US); Michael Au, Union City, CA (US); Yashvant Venkatakrishnan, San Jose, CA (US); Xiuming Zhu, San Jose, CA (US); Roland Kern, Wolfhausen (CH); Simone Kneipp, Munich (DE); Paul Wagner, Meilen (CH)

(73) Assignee: Sonova AG, Staefa (CH)

( * ) Notice: Subject to any disclaimer, the term of this patent is extended or adjusted under 35 U.S.C. 154(b) by 33 days.

(21) Appl. No.: 17/105,717

(22) Filed: Nov. 27, 2020

(65) Prior Publication Data

US 2022/0174439 A1 Jun. 2, 2022

(51) Int. Cl.
*H04R 25/00* (2006.01)

(52) U.S. Cl.
CPC ..... *H04R 25/654* (2013.01); *H04R 25/602* (2013.01); *H04R 25/604* (2013.01); *H04R 25/609* (2019.05); *H04R 2225/021* (2013.01); *H04R 2225/025* (2013.01)

(58) Field of Classification Search
CPC ..... H04R 2460/17
USPC ..... 381/325
See application file for complete search history.

(56) References Cited

U.S. PATENT DOCUMENTS

| | | | |
|---|---|---|---|
| 3,061,689 | A | 10/1962 | McCarrell et al. |
| 3,414,685 | A | 12/1968 | Geib et al. |
| 4,870,689 | A | 9/1989 | Weiss |
| 4,880,076 | A | 11/1989 | Ahlberg et al. |
| 4,937,876 | A | 6/1990 | Biermans |
| 4,957,478 | A | 9/1990 | Maniglia |
| 4,987,597 | A | 1/1991 | Haertl |
| 5,002,151 | A | 3/1991 | Oliveira |
| 5,015,224 | A | 5/1991 | Maniglia |
| 5,390,254 | A | 2/1995 | Adelman |
| 5,654,530 | A | 8/1997 | Sauer et al. |
| 5,682,020 | A | 10/1997 | Oliveira |
| 5,701,348 | A | 12/1997 | Shennib et al. |
| 5,712,918 | A | 1/1998 | Yoest |
| 5,742,692 | A | 4/1998 | Garcia et al. |
| 5,864,628 | A | 1/1999 | Posen et al. |
| 5,970,157 | A | 10/1999 | Yoest |
| 6,134,333 | A | 10/2000 | Flagler |
| 6,208,741 | B1 | 3/2001 | Shennib et al. |
| 6,212,283 | B1 | 4/2001 | Fletcher et al. |
| 6,795,562 | B1 | 9/2004 | Gunnersen et al. |

(Continued)

FOREIGN PATENT DOCUMENTS

| | | | |
|---|---|---|---|
| WO | WO 97/09864 | A1 | 3/1997 |
| WO | WO 2008/080397 | A1 | 7/2008 |

(Continued)

*Primary Examiner* — Suhan Ni
(74) *Attorney, Agent, or Firm* — Henricks Slavin LLP

(57) ABSTRACT

A hearing device including a housing, a receiver within the housing, and a contaminant guard having a guard sound port and one or both of an outer contaminant receptacle, which is located outward of the guard sound port and that extends around the guard sound port, and an inner contaminant receptacle, which that is located on the central axis of the guard sound port and operably connected to a location outward of the guard sound port.

16 Claims, 5 Drawing Sheets

(56) References Cited

U.S. PATENT DOCUMENTS

| | | | | |
|---|---|---|---|---|
| 7,313,245 | B1 | 12/2007 | Shennib | |
| 7,876,919 | B2 | 1/2011 | Ram et al. | |
| 8,284,974 | B2 * | 10/2012 | Pander | H04R 25/658 381/328 |
| 8,295,522 | B2 | 10/2012 | Vestergaard et al. | |
| 8,457,336 | B2 | 6/2013 | Ladabaum et al. | |
| 8,494,200 | B2 | 7/2013 | Ram et al. | |
| 8,755,548 | B2 * | 6/2014 | Zhao | H04R 25/652 381/328 |
| 8,942,406 | B2 * | 1/2015 | Koizumi | H04R 1/345 381/387 |
| 9,392,385 | B2 | 7/2016 | Nielsen et al. | |
| 9,820,062 | B2 | 11/2017 | Stewart | |
| 2003/0081805 | A1 * | 5/2003 | Fushimi | H04R 1/1016 381/325 |
| 2003/0198360 | A1 | 10/2003 | Niederdrank | |
| 2006/0147071 | A1 * | 7/2006 | Neilson | H04R 25/654 381/328 |
| 2006/0256990 | A1 | 11/2006 | Holmes | |
| 2007/0003086 | A1 * | 1/2007 | Tilson | H04R 25/654 381/328 |
| 2012/0163643 | A1 | 6/2012 | Vestergaard et al. | |

FOREIGN PATENT DOCUMENTS

| | | | |
|---|---|---|---|
| WO | WO 2013/091682 | A1 | 6/2013 |
| WO | WO 2018/153458 | A1 | 8/2018 |

* cited by examiner

CANAL HEARING DEVICES WITH SOUND PORT CONTAMINANT GUARDS

BACKGROUND

1. Field

The present inventions relate generally to hearing devices and, for example, hearing devices with at least a portion thereof that is worn in the ear canal.

2. Description of the Related Art

Many hearing devices (or portions thereof) are located within the ear canal. In-the-ear ("ITE") hearing devices, for example, typically include a housing that is positioned within the ear canal and a receiver that located within the housing. The housing has a sound output port that is positioned adjacent to the tympanic membrane and connected to the receiver output port. Other hearing device components (e.g., the microphone, electronics and battery) may in some instances be located within the housing. Completely in-the-canal ("CIC") hearing devices, for example, are extended wear devices that are configured to be worn continuously, from several weeks to several months, inside the ear canal. For example, some extended wear hearing devices are configured to rest entirely within the bony region, sometimes within 4 mm of the tympanic membrane. Examples of extended wear hearing devices are disclosed in U.S. Patent Pub. No. 2009/0074220, U.S. Pat. Nos. 7,664,282 and 8,682,016, each of which is incorporated herein by reference. Behind-the-ear ("BTE") hearing devices, on the other hand, typically include a BTE component, with the microphone, electronics, and battery, and an ITE component that delivers sound to ear canal. The ITE component may include a receiver assembly, with a receiver and a receiver housing, and a soft earpiece that is mounted on the medial end of the receiver assembly to center the receiver relative to the ear canal with the sound output port of the receiver housing facing the tympanic membrane.

One issue associated with extended wear ITE hearing devices and the ITE components of BTE hearings devices is the risk of solid and liquid cerumen, which is commonly referred to as "ear wax," as well as other contaminants (e.g., sweat, blood, water, sebum liquid), clogging the sound output port within the ear canal. One proposed solution is to mount a contaminant guard (sometimes referred to as a "wax guard") over the sound output port. Although conventional contaminant guards have proven useful, the present inventors have determined that they are susceptible to improvement. For example, the present inventors has determined that although conventional contaminant guards perform well with respect to solid contaminants, they are less effective against liquid contaminant ingress.

SUMMARY

A hearing device in accordance with at least one of the present inventions includes a housing, a receiver within the housing and including a receiver sound port, and a contaminant guard, associated with the receiver sound port, including a guard sound port and an outer contaminant receptacle that is located outward of the guard sound port and that extends around the guard sound port.

A hearing device in accordance with at least one of the present inventions includes a housing, a receiver within the housing and including a receiver sound port, and a contaminant guard, associated with the receiver sound port, including a guard sound port that defines a central axis, an inner contaminant receptacle that is located on the central axis, and at least one channel that extends from the inner contaminant receptacle to a location outward of the guard sound port.

There are a variety of advantages associated with the present hearing devices. For example, the outer contaminant receptacle reduces the likelihood that liquid cerumen (or other liquid contaminants) migrating along the exterior of the hearing device housing will reach the guard sound port. The inner containment receptacle reduces the likelihood that contaminants moving towards the guard sound port at a location near the central axis of the guard sound port will enter the sound guard port.

The many other features of the present inventions will become apparent as the inventions become better understood by reference to the following detailed description when considered in conjunction with the accompanying drawings.

BRIEF DESCRIPTION OF THE DRAWINGS

Detailed descriptions of the exemplary embodiments will be made with reference to the accompanying drawings.

DETAILED DESCRIPTION OF EXEMPLARY EMBODIMENTS

The following is a detailed description of the best presently known modes of carrying out the inventions. This description is not to be taken in a limiting sense, but is made merely for the purpose of illustrating the general principles of the inventions.

Figure 1:
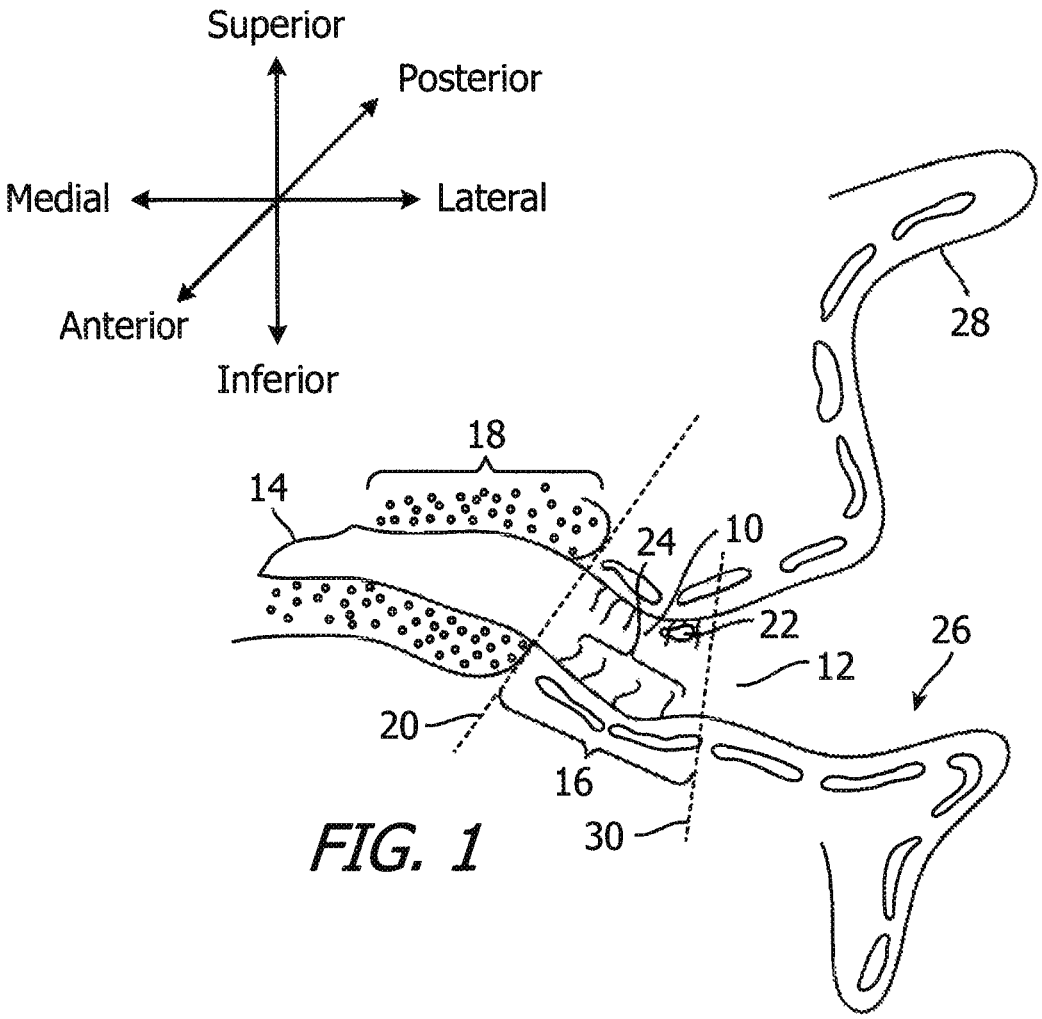
FIG. 1 is a section view showing the anatomical features of the ear and ear canal.

Referring to the coronal view illustrated in FIG. 1, the adult ear canal 10 extends from the canal aperture 12 to the tympanic membrane (or "eardrum") 14, and includes a lateral cartilaginous region 16 and a bony region 18 which are separated by the bony-cartilaginous junction 20. Debris 22 and hair 24 in the ear canal are primarily present in the cartilaginous region 16. The concha cavity 26 and auricle 28 are located lateral of the ear canal 10, and the junction between the concha cavity 26 and cartilaginous region 16 of the ear canal at the aperture 12 is also defined by a characteristic bend 30, which is known as the first bend of the ear canal.

It should be noted that as used herein, the term "lateral" refers to the direction and parts of hearing devices which face away from the tympanic membrane when within an ear canal, the term "medial" refers to the direction and parts of hearing devices which face toward the tympanic membrane when within an ear canal, the term "superior" refers to the direction and parts of hearing devices which face the top of the head when within an ear canal, the term "inferior" refers to the direction and parts of hearing devices which face the feet when within an ear canal, the term "anterior" refers to the direction and parts of hearing devices which face the front of the body when within an ear canal, and the "posterior" refers to the direction and parts of hearing devices which face the rear of the body when within an ear canal.

Figure 2:
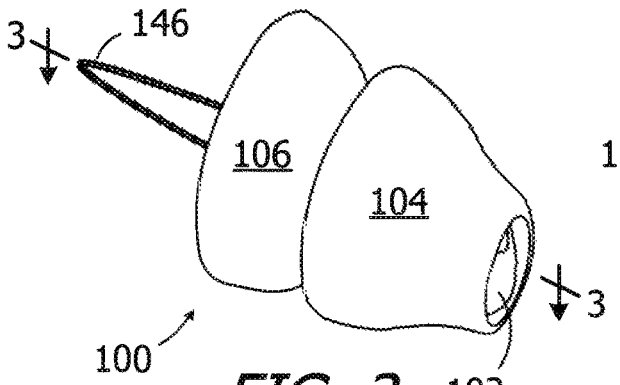
FIG. 2 is a perspective view of a hearing device in accordance with one embodiment of a present invention.
Figure 3:
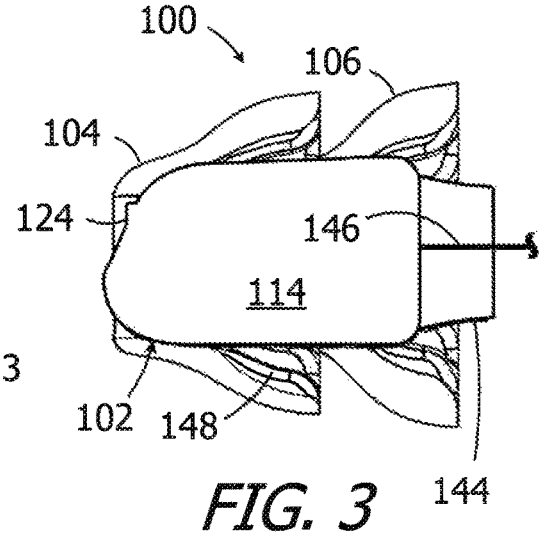
FIG. 3 is a partial section view taken along line 3-3 in FIG. 2.
Figure 4:
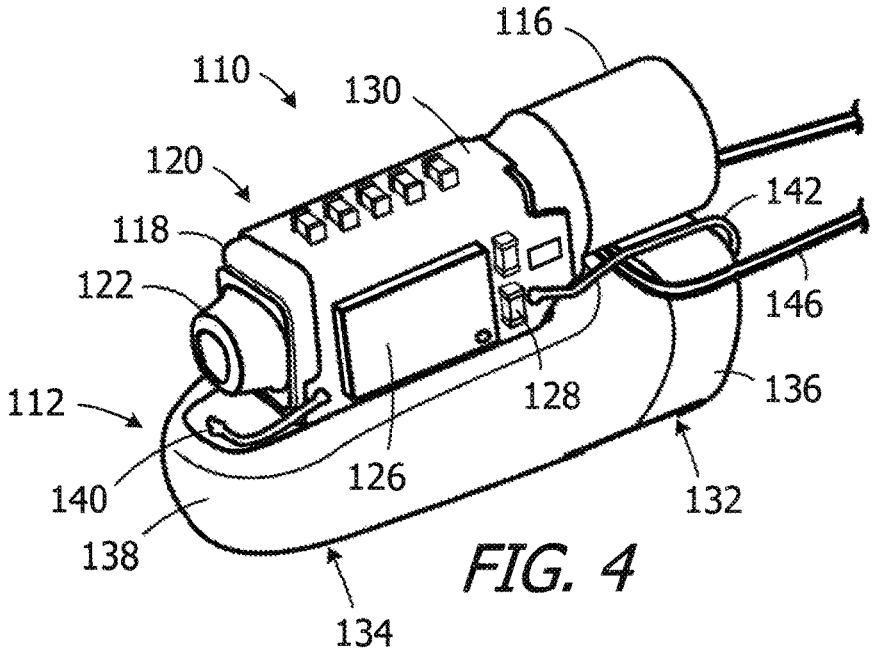
FIG. 4 is a perspective view of a portion of the hearing device illustrated in FIGS. 2 and 3.

One example of a hearing device is generally represented by reference numeral 100 in FIGS. 2-4. The hearing device 100 includes a core 102, a medial seal 104, and a lateral seal 106. Although the present inventions are not limited to any particular cores, the exemplary core 102 includes an acoustic assembly 110 and a battery 112 (e.g., metal-air battery) located within a housing 114. In the illustrated implementation, the acoustic assembly 110 and the battery 112, or the acoustic assembly alone, may be encased by an encapsulant to form the housing 114. In other implementations, the housing may be a pre-formed structure into which the acoustic assembly 110 and the battery 112 are inserted. The acoustic assembly 110 has a microphone 116, a receiver 118 and a flexible circuit 120. The receiver 118 has a sound port 122 and a contaminant guard 124 is associated with the sound port. The contaminant guard 124, which is discussed in greater detail below with reference to FIGS. 6-9, is configured to allow sound from the sound port 122 to pass and to also reduce the likelihood that contaminants will enter the sound port and prevent the hearing device 100 from functioning properly. The exemplary flexible circuit 120 includes an integrated circuit or amplifier 126 and other discreet components 128 on a flexible printed circuit board ("PCB") 130. The exemplary battery 112 has a cathode assembly 132 and an anode assembly 134. The exemplary cathode assembly 132 includes a battery can cathode portion 136 and an air cathode (not shown), and the exemplary anode assembly 134 includes a battery can anode portion 138 and anode material (not shown). The cathode assembly 132 and anode assembly 134 may initially be separate, individually formed structural elements that are joined to one another during the manufacturing process. The exemplary battery 112 is electrically connected to the PCB 130 by way of anode and cathode wires 140 and 142. The battery 112 may, in other implementations, be connected to a similar PCB via tabs of the PCB that attach to the battery, and in still other implementations the anode and cathode wires may be omitted and replaced by anode and cathode contacts on the cathode assembly. A contamination guard 144 (FIG. 3) with a screen (not shown) abuts the microphone 116. A handle 146 may also be provided. Additional details concerning the present hearing assistance device cores may be found in U.S. Pat. No. 8,761,423, which is incorporated herein by reference.

Figure 5:
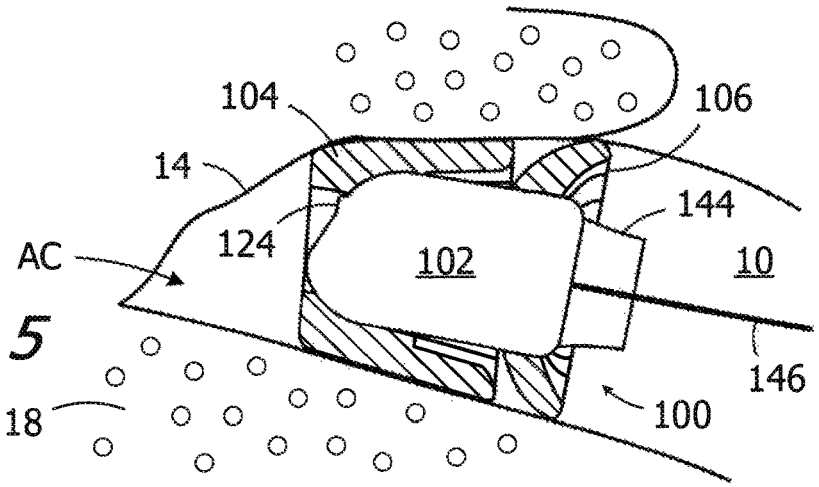
FIG. 5 is a partial section view showing the hearing device illustrated in FIGS. 2 and 3 within the ear canal.

The medial and lateral seals 104 and 106, which may be attached to the core 102 with adhesive or other suitable instrumentalities, support the core within the ear canal bony region 18 and are configured to substantially conform to the shape of walls of the ear canal 10, maintain an acoustical seal between a seal surface and the ear canal, and retain the hearing device 100 securely within the ear canal in the exemplary manner illustrated in FIG. 5. In particular, the sound port 122 and contaminant guard 124 face the tympanic membrane 14. An air cavity AC is defined between the tympanic membrane 14 and medial end of the hearing device 100.

The medial and lateral seals 104 and 106 may be identical or essentially identical, but for minor variations in shape and/or size, or may be different in shape and/or size. A plurality of scallops 148 may be used to impart the desired level of stiffness and conformability to the seals. With respect to materials, the medial and lateral seals 104 and 106 may be formed from compliant material configured to conform to the shape of the ear canal and provide necessary sound attenuation. Suitable materials include elastomeric foams having compliance properties (and dimensions) configured to conform to the shape of the intended portion of the ear canal (e.g., the bony portion) and exert a spring force on the ear canal so as to hold the hearing assistance device 100 in place in the ear canal. Exemplary foams, both open cell and closed cell, include but are not limited to foams formed from polyurethanes, silicones, polyethylenes, fluoropolymers and copolymers thereof. Hydrophilic polyurethane foam is one specific example. In at least some embodiments, all or a portion of the seals can comprise a hydrophobic material including a hydrophobic layer or coating that is also permeable to water vapor transmission. Examples of such materials include, but are not limited to, silicones and fluoropolymers such as expanded polytetrafluoroethylene (PTFE).

Figure 9:
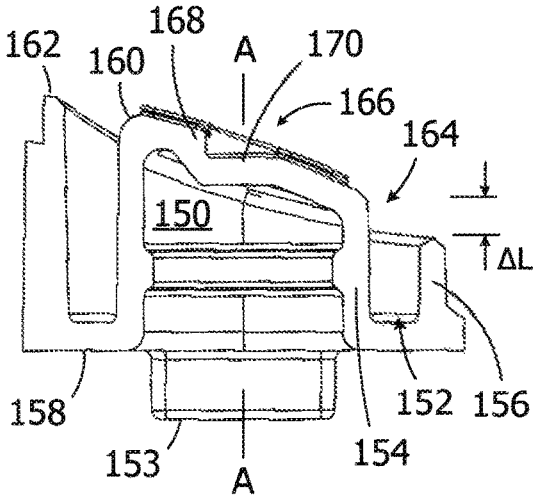
FIG. 9 is a section view taken along line 9-9 in FIG. 7.
Figure 9A:
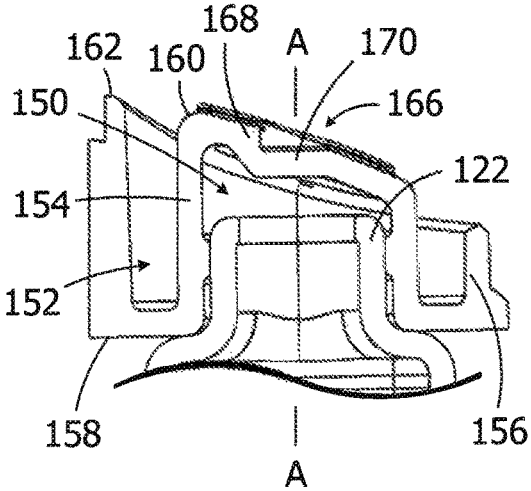
FIG. 9A is a section view showing the contaminant guard illustrated in FIG. 7 connected to a receiver sound port.

Turning to FIGS. 6-9A, the exemplary contaminant guard 124 includes a contaminant guard sound port (or "guard sound port") 150 and an outer contaminant receptacle 152. Sound from the receiver 118 passes through the guard sound port 150 and the receiver sound port 122 may be inserted into the guard sound port (FIG. 9A). Stand-offs 153 may be used to facilitate the assembly and molding process. The outer contaminant receptacle 152 extends around the guard sound port 150 and is located outward of the guard sound port. As used herein, a portion of the contaminant guard is located "outward of" another portion of the contaminant guard if it is located a greater distance from the central axis A (FIGS. 9 and 9A) of the guard sound port, while a portion of the contaminant guard is located "inward of" another portion of the contaminant guard if it is located a lesser distance from the central axis A of the guard sound port. The outer contaminant receptacle 152 extends continuously around the guard sound port 150 in the illustrated implementation. In other implementations, there may be areas of discontinuity.

There are a variety of advantages associated with the outer contaminant receptacle 152. By way of example, but not limitation, the outer contaminant receptacle 152 reduces the likelihood that liquid cerumen (or other liquid contaminants) migrating along the exterior of the housing 114 will reach the guard sound port 150. In particular, and referring to FIG. 9, the outer contaminant receptacle 152 creates a tortuous path that increases the distance that the migrating liquid contaminants must travel to reach the guard sound port 150. The migration of the contaminants, both liquid and non-liquid, will frequently end within the outer contaminant receptacle 152, resulting in contaminant build-up within the outer contaminant receptacle 152 instead of the guard sound port 150.

The exemplary contaminant receptacle 152 may in some implementations be located between an inner wall 154 and an outer wall 156. The inner wall 154, which extends from end wall 158 to a free end 160, defines the guard sound port 150. The outer wall 156 also extends from the end wall 158 to a free end 162. The outer contaminant receptacle 152 may be a volume defined by the inner wall 154, the outer wall 156 and the end wall 158.

Figure 6:
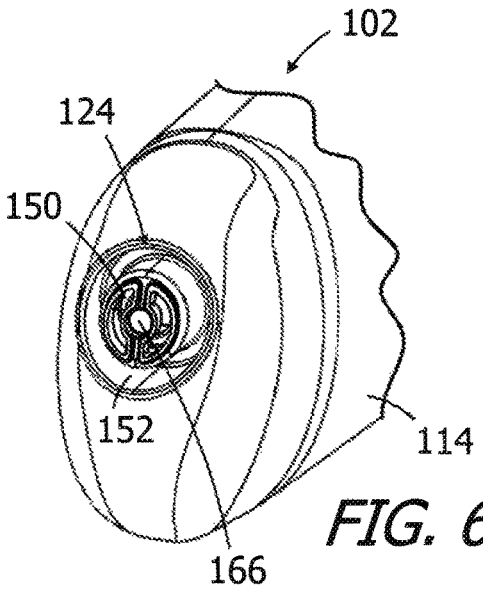
FIG. 6 is a perspective view of a portion of the hearing device illustrated in FIGS. 2 and 3.
Figure 7:
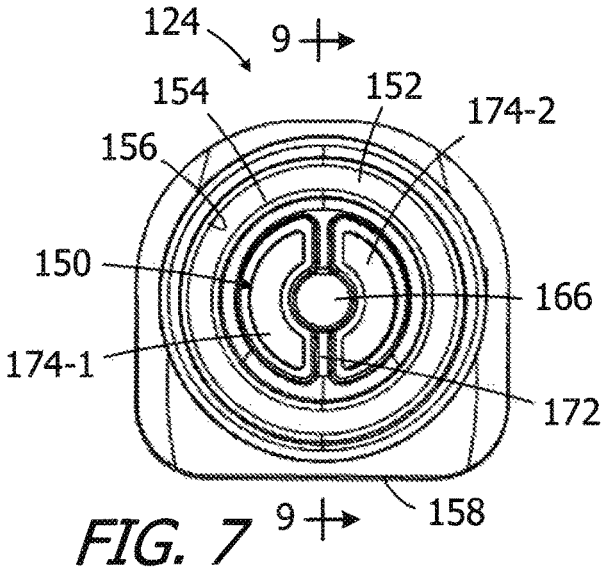
FIG. 7 is a front view of a contaminant guard in accordance with one embodiment of a present invention.
Figure 8:
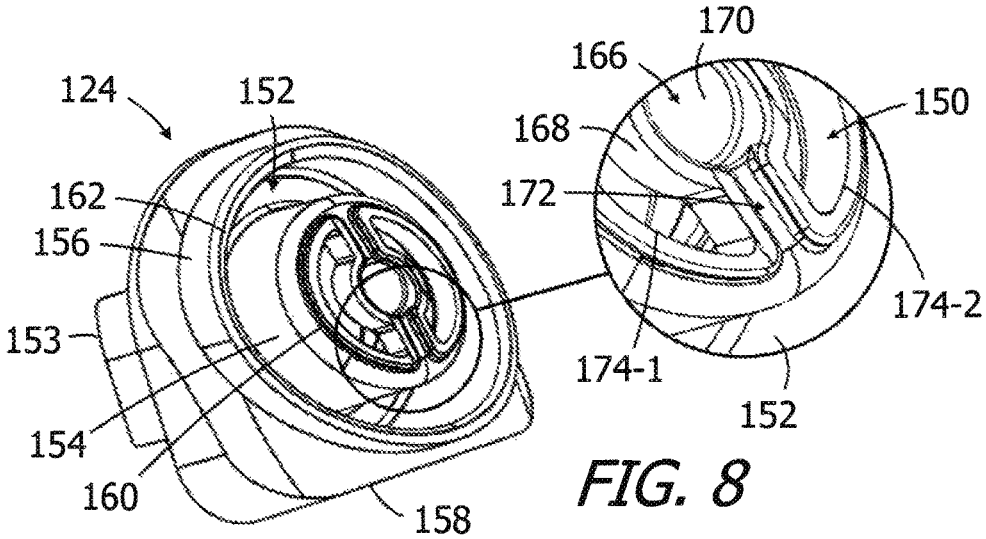
FIG. 8 is a perspective view of the contaminant guard illustrated in FIG. 7.

The inner and outer walls 154 and 156 may be any suitable shape or size. The respective shapes of the inner and outer walls 154 and 156 may be the same or different, as may be the lengths. Some or all of the inner and outer walls 154 and 156 may be annular in cross-sections perpendicular to the central axis A. In some implementations, one or both of the inner and outer walls may be cylindrical-shaped from one end to the other. The inner and outer walls 154 and 156 in the illustrated embodiment, on the other hand, have lengths that vary around their respective perimeters. To that end, the exemplary inner and outer walls 154 and 156 are in the shape of hollow cylindrical segments with free ends 160 and 162 that are non-perpendicular to the central axis A. The angled shape of the inner and outer walls 154 and 156 corresponds to the overall angled shape of the hearing device core 102 (FIG. 6). The hollow cylindrical segments are aligned with one another such that the longest portions of the inner and outer walls 154 and 156 are aligned with one another, as are the shortest portions. The free ends 160 and 162 may be parallel to one another (as shown) or non-parallel.

The length of the inner and outer walls 154 and 156, from the ends at the end wall 158 to the free ends, may be the same or different, and the lengths are different in the illustrated implementation. The inner wall 154 is longer than the outer wall 156 by a distance $\Delta L$, and the difference results in a step 164 (FIG. 9). The step 164 further reduces the likelihood that contaminants will migrate from the outer contaminant receptacle 152 to the guard sound port 150.

A contaminant receptacle may in some instances be located within a guard sound port. In the exemplary contaminant guard 124, an inner contaminant receptacle 166 is positioned inward of the inner wall 154 (and inward of contaminant receptacle 152) at or near the medial end of the guard sound port 150. The inner contaminant receptacle 166, whose location allows contaminants that are moving in the axial direction to be collected prior to passing through the guard sound port 150, includes a side wall 168 (e.g., the illustrated annular side wall) and a bottom wall 170. The inner contaminant receptacle 166 is suspended between portions of the inner wall 154 by one or more channels 172 that intersect the side wall 168. The exemplary embodiment includes a pair of channels 172 that, together with the inner contaminant receptacle 166, divide the end of the guard sound port 150 into a pair of openings 174-1 and 174-2. In addition to supporting the contaminant receptacle 166, the channels 168 provide a path for contaminants to travel from the inner contaminant receptacle 166 to the outer contaminant receptacle 152.

There are a variety of advantage associated with the inner contaminant receptacle 166. By way of example, but not limitation, the inner contaminant receptacle 166 reduces the likelihood that contaminants moving towards the guard sound port 150 at a location near the central axis A will enter the sound guard port. Such contaminants will instead be blocked by the inner receptacle 166 and will thereafter flow into the outer contaminant receptacle 152 by way the one or more channels 172. The receptacle 166 also collects solid cerumen and/or other containments that may be present on or near the central axis (e.g., during insertion of hearing device to the ear canal), thereby preventing the contaminants from entering the sound port directly.

The exemplary contaminant guard 124, as well as the other contaminant guards discussed herein, may include an oleophobic and/or hydrophobic coating to prevent the movement of contaminants into the guard sound port 150.

Figure 10:
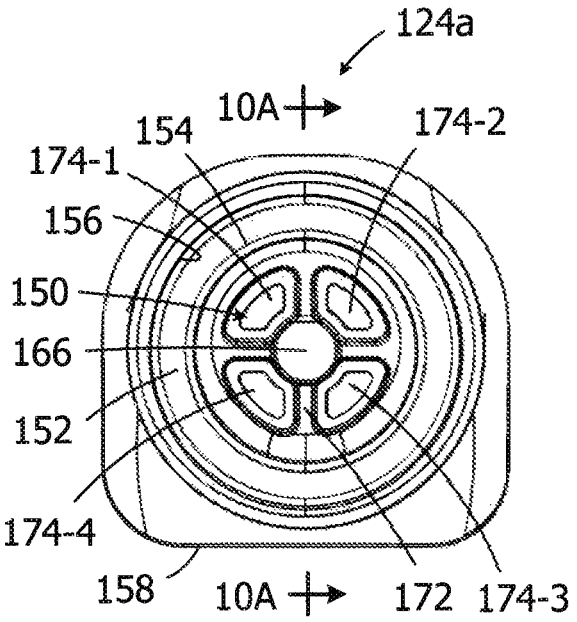
FIG. 10 is front view of a contaminant guard in accordance with one embodiment of a present invention.
Figure 10A:
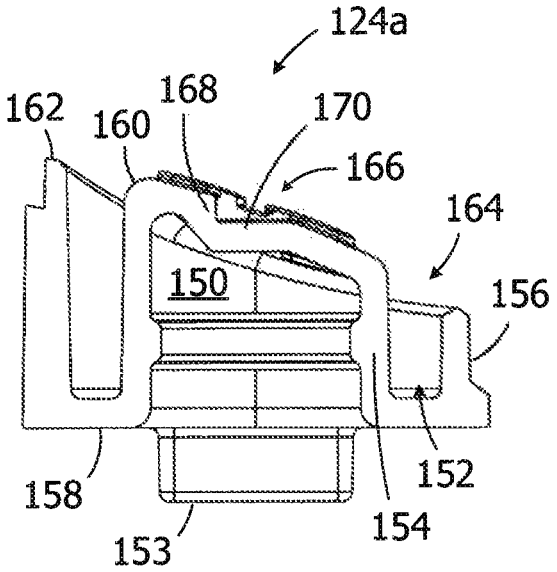
FIG. 10A is a section view taken along line 10A-10A in FIG. 10.

Another exemplary contaminant guard is generally represented by reference numeral **124*a* in FIGS. 10 and 10A. The exemplary contaminant guard 124*a* is substantially similar to contaminant guard 124 and similar elements are represented by similar reference numerals. Here, however, there are four channels 172 that, together with the inner contaminant receptacle 166, divide the end of the guard sound port 150 into four openings 174-1, 174-2, 174-3 and 174-4**.

Figure 11:
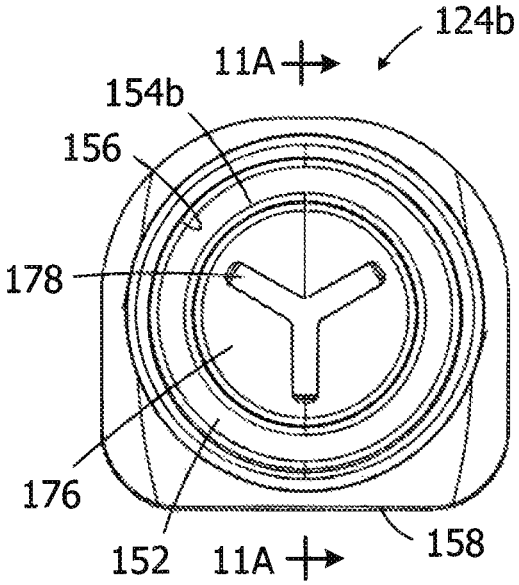
FIG. 11 is front view of a contaminant guard in accordance with one embodiment of a present invention.
Figure 11A:
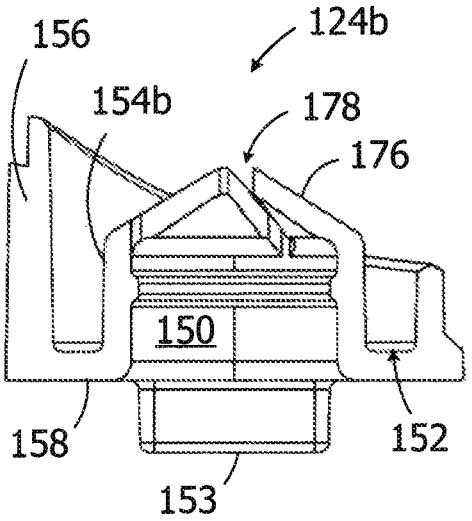
FIG. 11A is a section view taken along line 11A-11A in FIG. 11.

Turning to FIGS. 11 and 11A, the exemplary contaminant guard **124*b* illustrated therein is substantially similar to contaminant guard 124 and similar elements are represented by similar reference numerals. Here, however, the inner wall 154*b* is cylindrical, and the inner contaminant receptacle 166 and associated channels have been omitted. A contaminant shield 176, with sound passage slots 178, is positioned at end of the guard sound port 150. The exemplary contaminant shield 176 may bow outward (i.e., away from the receiver) with the apex of the shield being located at the intersection of the sound passage slots 178**.

Figure 12:
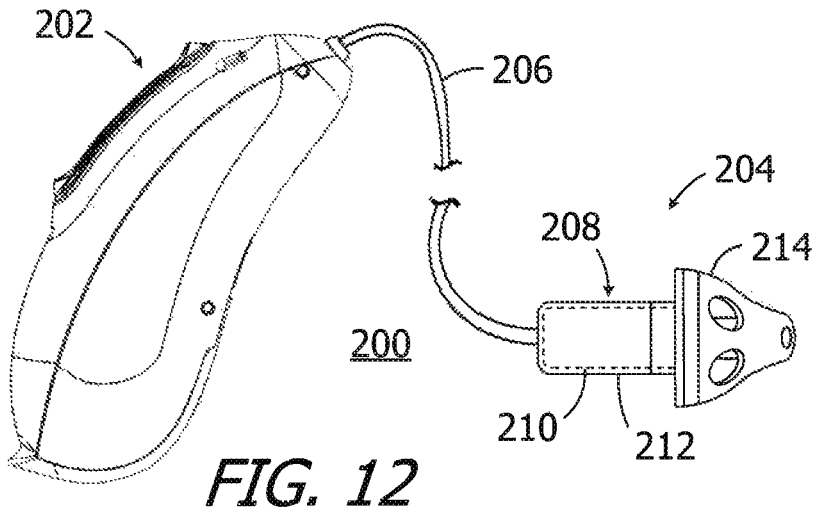
FIG. 12 is a side view of a hearing device in accordance with one embodiment of a present invention.
Figure 13:
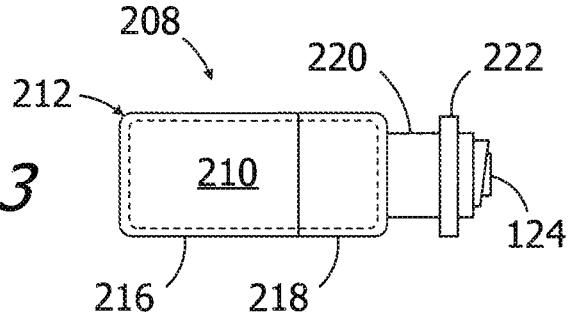
FIG. 13 is a side view of a portion of the hearing device illustrated in FIG. 12.

Another exemplary hearing device is generally represented by reference numeral 200 in FIG. 12. The exemplary hearing device 200 includes a behind-the-ear (BTE) component 202, with one or more microphones, a sound processor, a power source and other conventional instrumentalities, and an in-the-ear (ITE) component 204 that delivers sound to ear canal. A cable 206 electrically connects the BTE component 202 to the ITE component 204. The exemplary ITE component 204 includes a receiver assembly 208, with a receiver 210 and a receiver housing 212, and a soft earpiece 214 that is mounted on the medial end of the receiver assembly 208 to center the receiver relative to the ear canal. Referring also to FIG. 13, the receiver housing 212 has base 216, a cover 218, a tubular wall 220 that defines a sound tube with a sound output aperture (not shown) and an earpiece connector 222 that projects outward from the tubular wall. The exemplary contaminant guard 124 (or **124*a* or 124*b***) is located on the end of the tubular wall.

Figure 14:
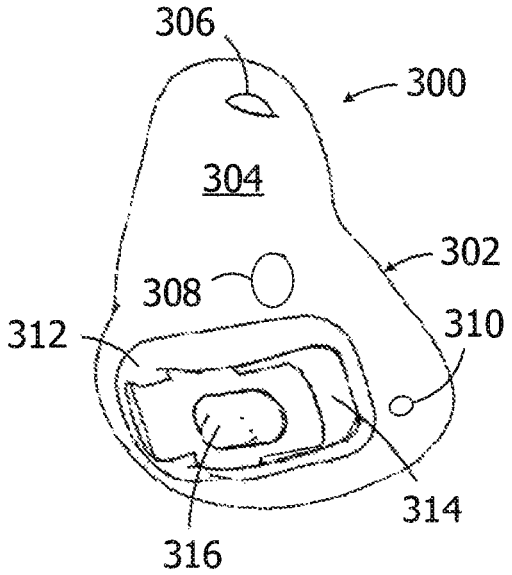
FIG. 14 is a perspective view of a hearing device in accordance with one embodiment of a present invention.
Figure 15:
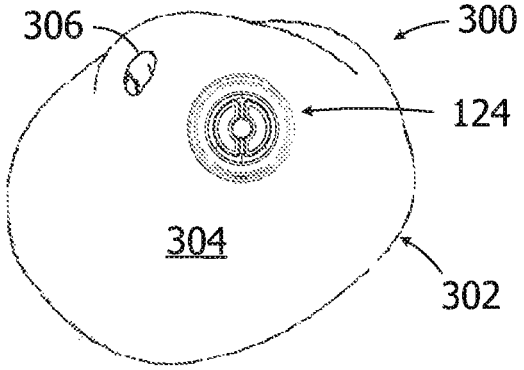
FIG. 15 is an end view of the hearing device illustrated in FIG. 14.

Turning to FIGS. 14 and 15, an exemplary in-the-ear (ITE) hearing device 300 includes a microphone, a receiver, a battery or other power supply, and sound processing electronics that are located within a housing 302. The exemplary housing 302, which is sized and shaped for positioning within the ear canal, includes a wall 304 with a sound output aperture (not shown) that is covered by the exemplary contaminant guard 124 (or **124*a* or 124*b*). The exemplary housing 302 also includes venting apertures 306 and 308, a handle aperture 310 for a removable handle (not shown). The shape of the housing 302 may be a generic shape that is suitable for a large number of patients or may be a custom shape that is 3D printed or otherwise formed for the ear canal of a particular patient. The exemplary hearing device 100 also includes a housing cover 312 at the lateral end of the housing 302. The battery may be stored at or within housing cover 312 and, to that end, the exemplary housing cover includes a pivotable battery door 314. A push button 316**, which may perform various function, may also be provided.

Although the inventions disclosed herein have been described in terms of the preferred embodiments above, numerous modifications and/or additions to the above-described preferred embodiments would be readily apparent to one skilled in the art. The inventions include any combination of the elements from the various species and embodiments disclosed in the specification that are not already described. The inventions also include the elements recited in claim 1 in combination with any and all combinations and sub-combinations of the elements recited in claims 2-10. The inventions also include the elements recited in claim 11 in combination with any and all combinations and sub-combinations of the elements recited in claims 12-18. It is intended that the scope of the present inventions extend to all such modifications and/or additions and that the scope of the present inventions is limited solely by the claims set forth below.

We claim:

1. A hearing device, comprising:
a housing;
a receiver within the housing and including a receiver sound port; and
a contaminant guard, associated with the receiver sound port, including
a guard sound port through which sound from the receiver sound port exits the contaminant guard,
an inner wall located outward of the guard sound port, an outer wall, and an end wall, and
an outer contaminant receptacle, defined by the inner wall, the outer wall, and the end wall, that is located outward of the guard sound port, that extends around the guard sound port and that has a closed end at the end wall and an open end that is medial of the closed end.

2. The hearing device claimed in claim 1, wherein
the outer contaminant receptacle extends continuously around the guard sound port.

3. The hearing device claimed in claim 1, wherein
the outer wall defines a perimeter and a length that varies around the perimeter; and
the inner wall defines a perimeter and a length that varies around the perimeter.

4. The hearing device claimed in claim 1, wherein
the contaminant guard includes an inner contaminant receptacle that is located inward of the outer contaminant receptacle and is operably connected to the outer contaminant receptacle.

5. The hearing device claimed in claim 4, wherein
the inner contaminant receptacle comprises a side wall and a bottom wall.

6. The hearing device claimed in claim 4, wherein
the inner contaminant receptacle is located within the guard sound port.

7. The hearing device claimed in claim 1, further comprising:
a microphone within the housing;
a battery; and
electronics within the housing and operably connected to the receiver, the microphone and the battery.

8. The hearing device claimed in claim 1, further comprising:
at least one seal, carried on the housing, configured to substantially conform to the shape of walls of an ear canal and retain the hearing device within the ear canal.

9. A hearing device, comprising:
a housing;
a receiver within the housing and including a receiver sound port; and
a contaminant guard, associated with the receiver sound port, including a guard sound port, an outer contaminant receptacle that is located outward of the guard sound port and that extends around the guard sound port, and an inner contaminant receptacle that is located inward of the outer contaminant receptacle and is connected to the outer contaminant receptacle by at least one channel that extends across a portion of the guard sound port.

10. The hearing device claimed in claim 9, wherein
the at least one channel comprises a plurality of channels that extend across respective portions of the guard sound port.

11. A hearing device, comprising:
a housing;
a receiver within the housing and including a receiver sound port; and
a contaminant guard, associated with the receiver sound port, including a guard sound port that defines a central axis, an inner contaminant receptacle that is located on the central axis, an outer contaminant receptacle that is located outward of the guard sound port, and at least one channel that extends from the inner contaminant receptacle to the outer contaminant receptacle.

12. The hearing device claimed in claim 11, wherein
the at least one channel comprises a plurality of channels.

13. The hearing device claimed in claim 11, wherein
the inner contaminant receptacle comprises a side wall and a bottom wall.

14. The hearing device claimed in claim 11, wherein
the inner contaminant receptacle is located within the guard sound port.

15. The hearing device claimed in claim 11, wherein
the contaminant guard includes an inner wall, an outer wall, and an end wall;
the outer contaminant receptacle is defined by the inner wall, outer wall, and end wall; and
the guard sound port is located inward of the inner wall.

16. The hearing device claimed in claim 11, further comprising:
a microphone within the housing;
a battery; and
electronics within the housing and operably connected to the receiver, the microphone and the battery.

* * * * *